US006305495B1

(12) United States Patent
Keegan

(10) Patent No.: US 6,305,495 B1
(45) Date of Patent: Oct. 23, 2001

(54) SURFACING PANELS FOR ACOUSTICAL CEILING SYSTEMS

(75) Inventor: Terence M. Keegan, Sylvania, OH (US)

(73) Assignee: Capaul Corporation, Plymouth, WI (US)

( * ) Notice: Subject to any disclaimer, the term of this patent is extended or adjusted under 35 U.S.C. 154(b) by 0 days.

(21) Appl. No.: 09/431,488

(22) Filed: Nov. 2, 1999

(51) Int. Cl.[7] ..... E04B 1/82

(52) U.S. Cl. ..... 181/290; 181/287; 181/295; 181/30

(58) Field of Search ..... 181/284, 286, 181/287, 290, 291, 293, 295, 30, 294

(56) References Cited

U.S. PATENT DOCUMENTS 3,021,247 * 2/1962 Stephens ..... 181/290
4,642,951 * 2/1987 Mortimer ..... 181/290
5,547,743 * 8/1996 Rumiesz, Jr. et al. ..... 181/290

* cited by examiner

*Primary Examiner*—Khanh Dang
(74) *Attorney, Agent, or Firm*—Sokol Law Office

(57) ABSTRACT

A rigid lightweight surfacing panel for providing a new surface for existing panels in acoustical panel ceiling systems, the surfacing panel having a degree of flex so to allow it to be pushed into place in a support system in underlying matched relation with an existing panel whereby a new decorative surface to impart a change in the existing decor or to decoratively replace damaged, worn or soiled surfaces can be provided without need for removing the existing panel. In a preferred embodiment porous surfacing panels are each made by combining a pair of flexible strand mats under heat and pressure with an interposed lightweight fibrous web of heat meltable binder and providing the combination with a decorative exposed surface layer which allows transmission of sound through the combination to an overlying existing ceiling panel. When called for, a concave shape can be molded into the exposed side of the panel to permit it to bear the load of an existing panel which might otherwise cause the surfacing panel to sag.

12 Claims, 3 Drawing Sheets

SURFACING PANELS FOR ACOUSTICAL CEILING SYSTEMS

This present invention is a molded panel or board formed of flexible mats of continuous or chopped strands of high performance filaments for use as decorative surfacing panels for acoustical ceiling systems.

BACKGROUND

The surfacing panels of the present invention have been developed particularly to provide a new decorative surface for existing acoustical tile or panel systems such as where the tiles or panels, because of age have become soiled by heat, light and dust as well as other contaminants circulating in the ceiling area such as at air conditioning outlets and inlets or where the acoustical units have become damaged in use over a prolonged period.

BRIEF DESCRIPTION OF THE INVENTION

The panels of the invention are thin and lightweight such that they can be readily lifted and maneuvered by a person, even a non-skilled person, and have a degree of flex such that they can be pushed into an existing acoustical grid system in underlying relation with existing tiles in the system. That is the surfacing panels are made to have a degree of springiness so that they can be flexed or bowed slightly to permit their being pushed into place for support and coverage of the exposed surfaces of panels of an existing panel system without removal of panels from the system. A wide range of decorative surfaces can be provided on the surfacing panels to replace the appearance of panels already in place. In this regard, if desired the surfacing panels of the invention can be installed merely to change the decor of the ceiling in a dwelling space such as in a home or office.

The panels are dimensionally stable with a degree of stiffness and rigidity and a strength to weight ratio such that they can underlie and span the surface expanse of existing panels without sagging. In this regard, if because of age a curvature exists in a panel to be covered such that a surfacing panel would tend to be pushed downward due to contact with an overlying panel, the surfacing panel can be molded with a slight concavity or bow on its underside so that in a sense it becomes pre-stressed against the weight of an overlying panel. That is, the weight of the panel on the upper side of the panel can act to straighten the bowed surfacing panel into desired planar alignment in the system. With this design capability the surfacing panel has the feature of lending itself to even a lighter weight construction and adaptability to use for decorative purposes.

To attain desired lightweight and strength, the panels it has been found can be made basically of two thin layers of flexible mats of continuous filament strands such as mats of non-woven, randomly swirled continuous glass filament strands or randomly oriented chopped segments of continuous strands interbonded such as by a polyester binder. The two layers of strand mats are combined in interbonded relation by a lightweight dry thermoplastic adhesive such as is available in the form of a non-woven fibrous webbing.

The exposed top layer of the panels can be selected to provide any of a wide range of desired decorative appearances. In this regard for example the top layer having a color providing a desired aesthetic appearance can be a nubby or other textured woven or non-woven fiber fabric or a non-woven chopped strand mat as of glass filaments. Another type of decorative top layer that can be incorporated in the panel for example, is a layer of vinyl film or other resin film such as Mylar which can be of a selected desired color. Such a film can also be provided with a printed configuration for decoration to still further enhance the aesthetic appearance of the product. The top layer in addition to providing decorativeness adds to the strength of the combination.

The amount of dry adhesive web material effective to bond the basic strand mats, for example, can be of light weight in the order of 0.17 oz/sq. yd and make up as low as 2 percent of the final product weight. The individual mats in the panel by way of example, can be of thickness of about 1/16th inch and have a weight of approximately 0.0235 pounds per square foot. A vinyl outer exposed surface can be bonded to the two interbonded layers of strand mat by application of heat and pressure or the combination or also by a layer of web adhesive compatible with the vinyl material. A film face of resin as pointed out above can be of any number of colors, and patterns can be imprinted on the film surface to expand the range of aesthetics. The film layer can act as a drum like membrane for sound transmission and/or can be provided with perforations to allow sound passage through the thin exposed surface of the panel.

If a nubby surface is provided on the panel, the surfacing layer, by way of example, can have a thickness in the order of 30 mils and have a weight of approximately 0.1 lb. per sq ft. The complete panel assembly made up of two interbonded layers of strand mat, for example, can have a thickness of about 60 mils but with a nubby surfacing material the panel assembly can have a thickness dimension of about 90 mils. The strength to weight ratio of the assembly is such that because of the lightweight of the relatively high strength interbonded mats and their decorative surfacing, the panels do not sag. The product eliminates the need for removing existing ceiling panels, thereby reducing the cost of installation of what once installed, appears to be an entirely new ceiling system. The panels of the invention thus not only rejuvenate old and worn ceiling systems but in addition permit provision of an entirely different appearance when redecoration of a dwelling space is desired.

The terms panel and tile as used herein are interchangeable as commonly used in that both are applicable usually to surface units in acoustical support systems in dwelling spaces.

An object of the invention is to provide an economical method and means for renovating or redecorating existing ceiling tile systems.

Another object of the invention is to provide a surfacing panel of lightweight which will not overburden the frequently not too structurally strong grid support system and having a degree of manual flex such that it can be readily pushed into place in an existing ceiling grid system in underlying relation with an existing ceiling panel.

A further object of the invention is to provide a surfacing panel of lightweight and strong enough to bear the weight, if necessary, an existing tile supported in a tile support system.

Still another object of the invention is to provide a surfacing panel for existing acoustical tile systems which when installed does not diminish acoustical properties of the system but in some instances can even enhance the acoustical properties of the system.

A principal feature of the invention is the capability of the surfacing panels to economically provide an entirely new appearance to a ceiling tile system without requiring removal of existing tiles.

Another feature of the invention is the wide range of decorative selections which can be provided on the surfacing panel, including a wide range of different surface textures and colors from which a selection can be made.

Still another feature of the invention is the springiness and flex characteristics of the panel which allows it to be bowed to facilitate its being pushed into place under a panel in a grid support system.

A further feature of the invention is the capability of providing a surfacing panel which can be made or cut to dimensions matching panels or tiles in an existing panel or tile support system.

Other objects and features which are believed to be characteristic of my invention are set forth with particularity in the appended claims. My invention, however, both in organization and manner of construction, together with further objects and features thereof, may be best understood by reference to the following description taken in connection with the accompanying drawings.

THE DRAWINGS

DETAILED DESCRIPTION

Figure 1:
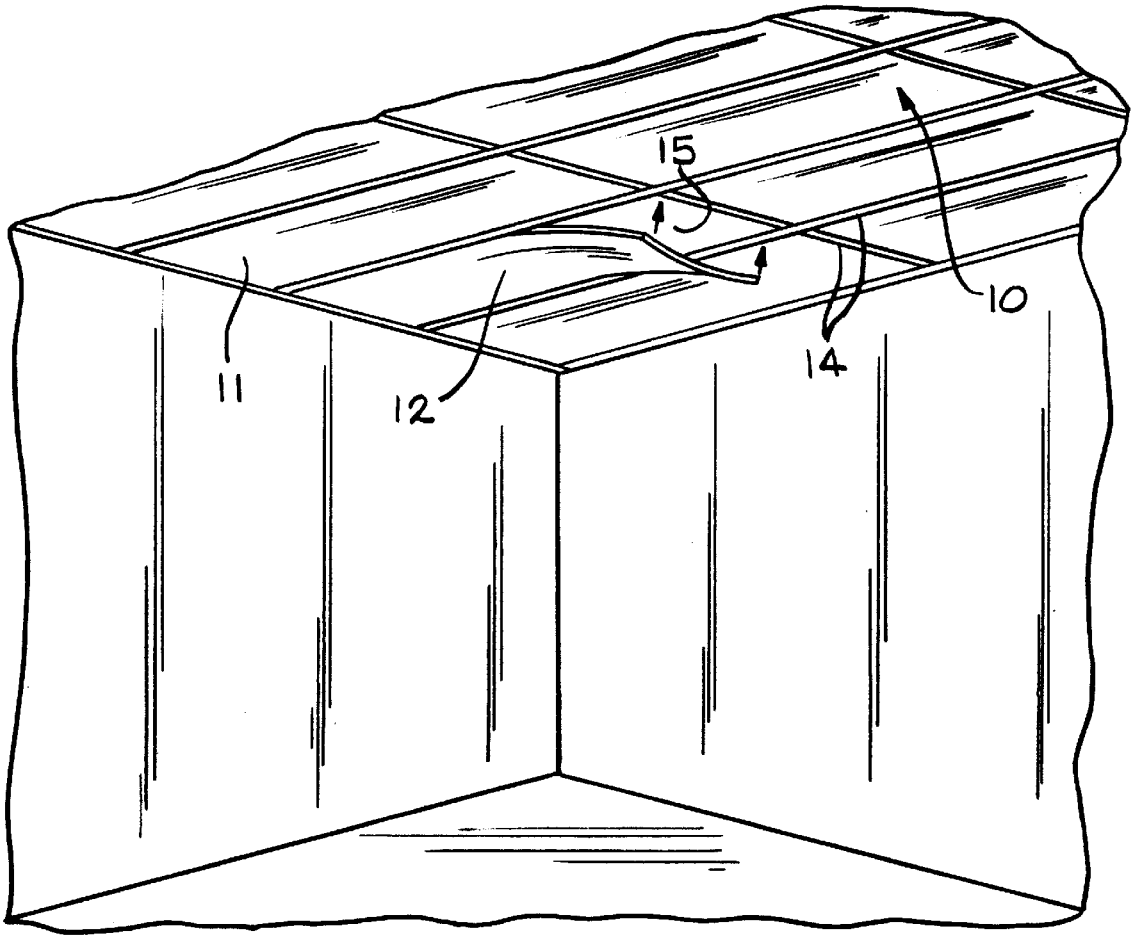
FIG. 1 is a general illustration of a portion of the acoustical ceiling system in which panels are supported in a grid system and illustrating how a panel of the present invention can be pushed into underlying relation with a panel already supported in the system.

FIG. 1 illustrates a panel support system in which surfacing panels 11 are supported in a grid system 14. A surfacing panel 11 is illustrated as a panel, partially inserted in the grid system and being pushed upwardly in a flexed condition to be placed in underlying relation with an already existing panel 15 supported by the system. In other words the panel is in a sense bowed or flexed with a degree of planar distortion to allow its installation in supporting relation under the panel 15.

Figure 2:
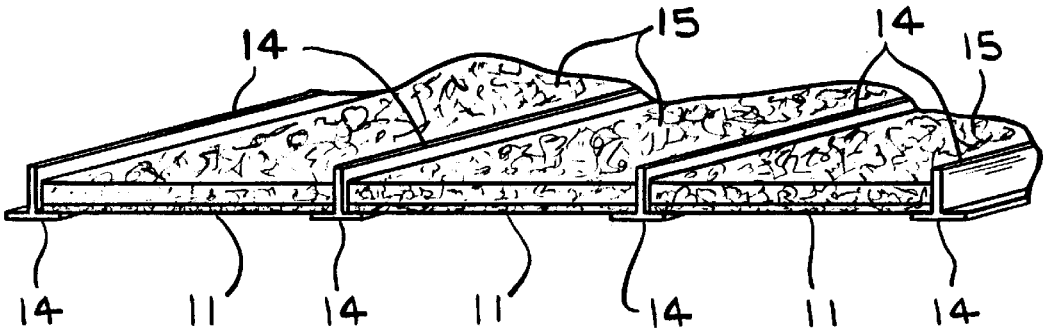
FIG. 2 is an illustration of a portion of a panel support system in which panels of the invention are supported in underlying relation with panels already existing in the system.

FIG. 2 illustrates more clearly how the grid system is made up of a series of elongated T-members 14 joined together to form the grid in which the existing panels 15 supported in the system are provided with underlying new surfacing panels 11 which are supported at their edges by flanges of opposing T-members. The underlying surface panels 11 thereby also act to support the overlying existing acoustical panels 15.

Figure 3:
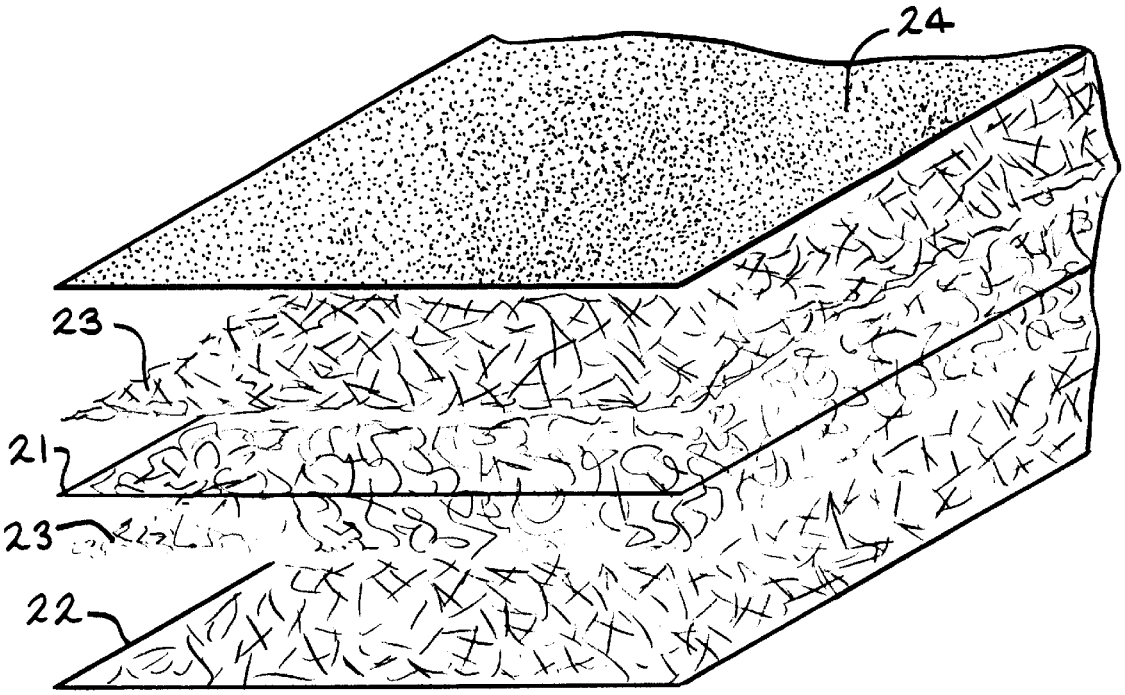
FIG. 3 is an illustration of component layers of the lightweight panel of the invention illustrated in FIGS. 1 and 2 with the exposed major surface of the panel at the top.

FIG. 3 illustrates in somewhat exploded fashion the component layers of the surfacing panels 11. The assembled components in this figure are shown inverted from the panels illustrated in FIGS. 1 and 2 in that the exposed surface 24 in FIG. 3 is shown at the top, whereas in use in FIGS. 1 and 2 it would be inverted with the exposed surface shown at the bottom of the grid system. The panels 11 are exemplified by a combination of two chopped continuous filament strand mats 21 and 22 preferably of glass filaments which are provided with an interposed heat softenable veil-like web of dry adhesive 23 which under heat and pressure applied to the combination effects an interbonding of the chopped stand layers 21 and 22. The chopped strand mat layers 21 and 22 for example can be made of a range of different materials including strands of continuous filaments of glass resin. Chopped glass strands are preferred because of their desired strength and relatively low cost and their fire resistant properties.

The strands in chopped or in continuous condition are randomly distributed and intermingled to form the flexible layer but upon being interbonded by the adhesive veil-like web layer 23 under pressure and heat at about 350 F. the combination acquires a degree of rigidity and dimensional stability to provide the desired thin, high strength to weight ratio surfacing panel for existing panel systems.

Because of the lightweight of the individual mats 21 and 22 and the even lighter weight of the veil-like dry binder material interposed therebetween, the integrated combination is light in weight. With the strength of the chopped filaments such as chopped strand filaments, a degree of rigidity and strength is attained, yet with a degree of flex such that the panel formed by the combination provides an admirable surfacing product adaptable to easy installation in existing systems and to acceptance of a wide range of decorative appearances on its exposed surface.

In this regard, a nubby fabric or sheet appearance can be provided on the exposed surface by combining a layer of the nubby nonwoen glass filament fabric with the exposed surface side of the panel. Such fabric can be adhesively secured to the layer with any of a number of adhesives, but preferably with another lightweight veil-like layer such as used to combine the mats 21 and 22. The entire combination of the exposed surface layer and the two mats can be combined together in one heating and pressurization operation to reduce the cost of production.

A thin continuous film of resin material can also be used as a decorative layer placed in overlying relation with the combined mats to provide the exposed panel surface. The exposed surface of a thermoplastic film can be combined under heat and pressure with the top layer of mats by use of a layer of dry adhesive such as another layer 23 of binder material in fibrous veil form. In adopting a continuous film layer, a wide range of colors are available from which a selection can be made as well as any number of decorative prints which can be imprinted on the film to enhance the decorative character of the surfacing panels.

A commercially available veil-like dry adhesive layer which has been used successfully is a hot melt adhesive fibrous web supplied in nonwoven form and sold under the tradename Spunfab by Sunfab, Ltd., of Cyahoga Falls, Ohio. By use of the dry adhesive webs to interbond strand layers, and the decorative exposed layer, environmental problems are reduced or eliminated in that the dry material does not involve the use of harmful solvents or does not produce noxious odors, or particulate residue hazards. The material of the veil-like fibrous thermoplastic dry adhesive web can be provided based upon a polyamide, polyester, elastomeric, urethane, or olefin polymer.

Figure 4:
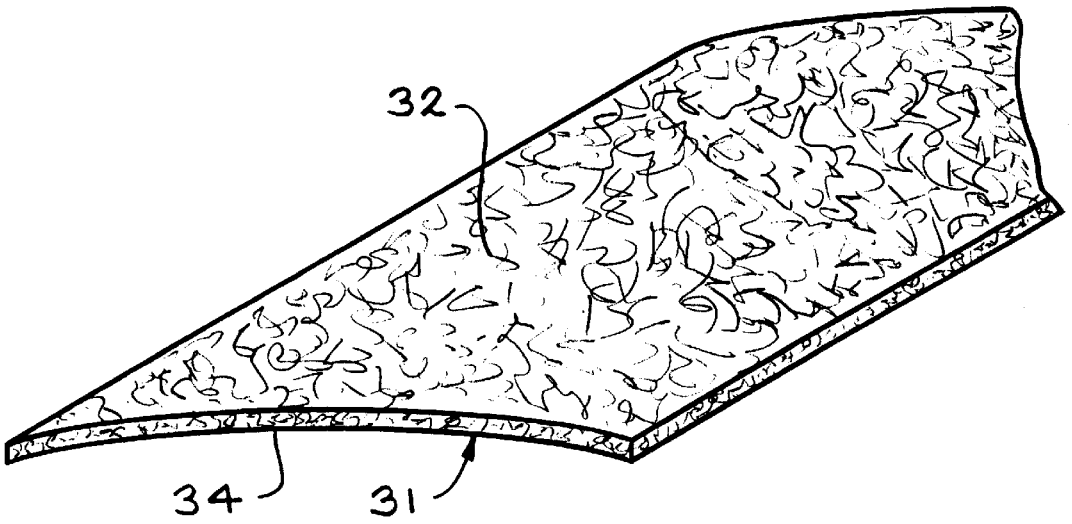
FIG. 4 is an illustration of a panel of the invention molded with a slight bow or concavity on the exposed undersurface of the panel designed to be straightened without a sag by the weight of an overlying existing panel in a system such as is illustrated in FIGS. 1 and 2.

FIG. 4 illustrates a panel of the invention which is molded in a slightly bowed shape such that a concavity is provided width-wise on its underside. The panel 31 is convex on its upperside 32 and provided with a slight concavity on its underside 34 so that in cases where sagging might be experienced the desired support strength is distributed under the entire surface of an existing panel. That is with a slight bow in the surfacing panel, upon its installation in underlying relation with a sagging existing panel, the panel 31 is in a sense pre-stressed and acts to support the overlying panel over its entire otherwise exposed area and can be straightened to a flat planar condition by the weight of the panel. The panel can alternately be molded with a lengthwise concavity where conditions call for such a shaping.

Figure 5:
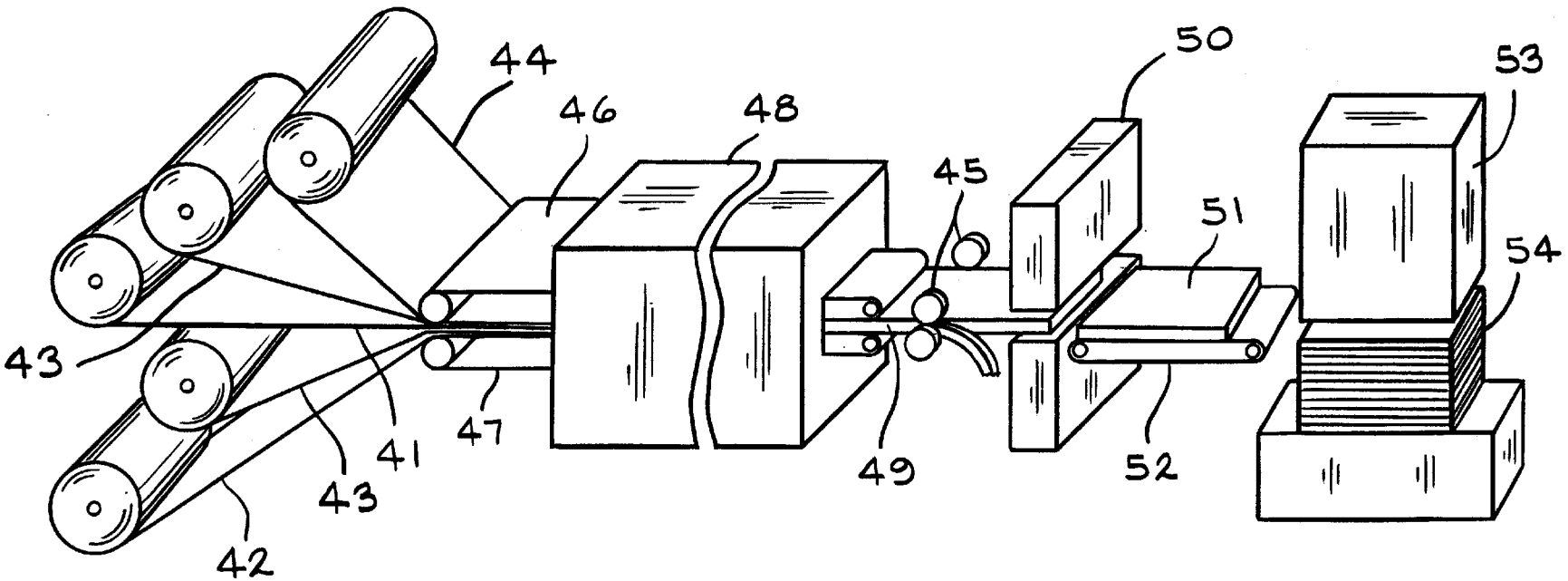
FIG. 5 is a schematic illustration of a production line facility for continuous production of panels of the invention.

FIG. 5 illustrates a continuous production facility for making panels of the invention wherein two chopped strand mats, or swirled continuous strand mats, 41 and 42 are drawn from supply rolls and a veil-like dry adhesive web 43 is drawn therebetween from a supply roll. The exposed surface 44 such as a resin film layer of the panel is drawn from an upper roll and another adhesive web 43 thereunder and then all five layers of a panel are drawn together between compression flights 46 and 47 of the production facility. The overlying and underlying flights 46 and 47 pass through an oven 48 and the combination of the respective layers 41, 43, 42, 43 and 44 is integrated under heat and pressure in the oven and is fed from between the flights 46 and 47 as a continuous integrated rigid panel combination 49. The combination is edge trimmed by opposite side rotary trimmers 45 and then chopped by a cutter 50 into completed panels 51 conveyed forward by a carrier conveyer 52 to a stacker 53 which stacks the panels into a stack 54. The panels can be made to any desired dimension but are usually made to match acoustical panels commonly available commercially in dimensions such as 2 ft by 2 ft or 2 ft by 4 ft.

The decorative layer of sufficient strength combined with a single layer of strand mat either of chopped strands or continuous strands, in some design situations, especially with lightweight existing ceiling panels, can provide a nonsagging surfacing panel which will fulfill the objectives of the invention.

In view of the foregoing it will be understood that many variations of the disclosed invention can be provided within the broad scope of the principles embodied therein. Thus, while particular preferred embodiments of the invention have been shown and described, it is intended by the appended claims to cover all such modifications which fall within the true spirit and scope of the invention.

What is claimed is:

1. A ceiling surfacing panel for an existing suspended ceiling, wherein the suspended ceiling includes a support grid and a plurality of existing ceiling panels, the support grid being formed by a series of longitudinal members and a series of cross members that define a plurality of similarly shaped openings, each grid member having a vertical section and a horizontal flange, each opening having a wider upper portion formed by the vertical sections and a narrower lower portion formed by the flanges, the existing ceiling panels having a perimeter and a lower surface, the perimeter of each existing ceiling panel being received between the vertical sections of one opening and supported by the horizontal flanges of that opening, and said ceiling surfacing panel comprising:

a first thin, lightweight mat formed from an integrated mass of randomly distributed chopped filament strands, said first mat having upper and lower surfaces;

a second thin, lightweight mat formed from an integrated mass of randomly distributed chopped filament strands, said second mat having upper and lower surfaces;

a first bonding layer provided between said lower surface of said first mat and said upper surface of said second mat, said bonding layer interbonding said first and second mats together;

a decorative resin layer;

a second bonding layer provided between said lower surface of said second mat and said resin layer, said second bonding layer interbonding said resin layer to said lower surface of said second mat; and, wherein said mats, decorative resin layer and bonding layers combining to form a resilient, integrated, multi-layered ceiling surfacing panel having a normally bowed shape with a concavity along said resin layer and a predetermined degree of stiffness, said multi-layer surfacing panel being flexibly movable from said normally bowed shape into a stressed, substantially planar orientation; and, wherein said multi-layer ceiling surfacing panel has a middle and a perimeter, and is flattened by the existing ceiling panel into said substantially planar orientation when placed between the horizontal flanges of the support grid and the existing ceiling panel, and wherein said degree of stiffness and substantially planar orientation prevent said middle of said multi-layered surfacing panel from sagging when supported along its said perimeter by the horizontal flanges.

2. The ceiling surfacing panel of claim 1, and wherein said ceiling surfacing panel is adapted to bend into a flexed orientation for insertion through the narrower lower portion of one of the openings in the support grid.

3. The ceiling surfacing panel of claim 2, and wherein each of said bonding layers is applied in a fibrous veil-like web form.

4. The ceiling surfacing panel of claim 3, and wherein said bonding layer is a dry layer of heat softenable material having a weight of about 0.17 ounces per square yard.

5. The ceiling surfacing panel of claim 2, and wherein said first and second mats are coextensive, and said multi-layer surfacing panel is coextensive with the existing ceiling panel.

6. The ceiling surfacing panel of claim 5, and wherein each of said mats are fiberglass and have a thickness of about 1/16 inch and a weight of about 0.0235 pounds per square foot.

7. A ceiling surfacing panel for an existing suspended ceiling including a support grid and a plurality of existing ceiling panels, the support grid being formed by a series of longitudinal members and a series of cross members that define a plurality of similarly shaped openings, each grid member having a vertical section and a horizontal flange, each opening having a wider upper portion formed by the vertical sections and a narrower lower portion formed by the flanges, the existing ceiling panels having a perimeter and a lower surface, the perimeter of each existing ceiling panel being received between the vertical sections of one opening and supported by the horizontal flanges of that opening, said ceiling surfacing panel comprising:

a first thin, lightweight mat formed from an integrated mass of randomly distributed chopped filament strands, said first mat having upper and lower surfaces;

a second thin, lightweight mat formed from an integrated mass of randomly distributed chopped filament strands, said second mat having upper and lower surfaces;

a bonding layer between said lower surface of said first mat and said upper surface of said second mat, said bonding layer interbonding said mats together to form a resilient, acoustically porous, integrated, multi-layered ceiling surfacing panel having a normal, substantially planar orientation and a predetermined degree of stiffness, said multi-layer ceiling surfacing panel having a middle, a perimeter and upper and lower surfaces, said multi-layer ceiling surfacing panel being substantially coextensive with the existing ceiling panel; and, wherein said multi-layer ceiling surfacing panel is adapted to flexibly move from said normal, substantially planar orientation into a substantially flexed orientation for insertion through said narrower lower portion of the opening in the grid and to return to and maintain in said normal, substantially planar orientation for placement between the horizontal flanges of the support grid and the existing ceiling panel, and wherein said degree of stiffness prevents said middle of said multi-layered ceiling surfacing panel from sagging when supported along its perimeter.

8. The ceiling surfacing panel of claim 7, and further including a resin layer and second bonding layer interbonded to said lower surface of said second mat, said mats and bonding layers and resin layers combining to form said resilient, multi-layered ceiling surfacing panel.

9. The ceiling surfacing panel of claim 8, and wherein each of said bonding layers is applied in a fibrous veil-like web form.

10. The ceiling surfacing panel of claim 9 and wherein said bonding layer is a dry layer of heat softenable material having a weight of about 0.17 ounces per square yard.

11. The ceiling surfacing panel of claim 8, and wherein said first and second mats are coextensive, and said multi-layer ceiling surfacing panel is coextensive with the existing ceiling panel.

12. The ceiling surfacing panel of claim 11, and wherein each of said mats are fiberglass and have a thickness of about 1/16 inch and a weight of about 0.0235 pounds per square foot.

* * * * *